US009227308B2

(12) United States Patent
Wang

(10) Patent No.: US 9,227,308 B2
(45) Date of Patent: Jan. 5, 2016

(54) PNEUMATIC RATCHET WRENCH

(71) Applicant: Yun-Ting Wang, Taichung (TW)

(72) Inventor: Yun-Ting Wang, Taichung (TW)

( * ) Notice: Subject to any disclaimer, the term of this patent is extended or adjusted under 35 U.S.C. 154(b) by 227 days.

(21) Appl. No.: 14/053,556

(22) Filed: Oct. 14, 2013

(65) Prior Publication Data

US 2014/0109729 A1 Apr. 24, 2014

(30) Foreign Application Priority Data

Oct. 18, 2012 (TW) ..... 101220114 U
Nov. 26, 2012 (TW) ..... 101222885 U

(51) Int. Cl.
*B25B 21/00* (2006.01)
*B25B 21/02* (2006.01)

(52) U.S. Cl.
CPC ..... *B25B 21/004* (2013.01); *B25B 21/026* (2013.01)

(58) Field of Classification Search
CPC ..... B25B 21/004; B25B 21/026; F01C 13/02
See application file for complete search history.

(56) References Cited

U.S. PATENT DOCUMENTS

| | | | | |
|---|---|---|---|---|
| 4,919,022 | A * | 4/1990 | Ono et al. | 81/464 |
| 6,082,986 | A * | 7/2000 | Seward et al. | 418/270 |
| 6,217,306 | B1 * | 4/2001 | Seward et al. | 418/270 |
| 6,241,500 | B1 * | 6/2001 | Ellis | 418/270 |
| 8,117,947 | B2 * | 2/2012 | Chiang | 81/57.39 |
| 8,261,849 | B2 * | 9/2012 | Kobayashi | 173/109 |
| 8,844,646 | B2 * | 9/2014 | Lu | 173/169 |
| 2007/0084311 | A1 * | 4/2007 | Albertson et al. | 81/57.39 |

* cited by examiner

*Primary Examiner* — David B Thomas

(57) ABSTRACT

A pneumatic ratchet wrench is connected with an air supply device and contains: a housing, a ratchet head unit, an impact clutch unit, and a driving unit. The housing extending along a first axis line and includes an opening defined on a front end thereof and an intake formed on a distal end thereof so as to couple with an air supply device. The ratchet head unit is received in the housing and includes a drive square extending along a second axis line and extending out of the opening The impact clutch unit is received in the housing and is coupled with the ratchet head unit. The driving unit is disposed in the housing and includes a multi-chamber cylinder, a rotor member inserted into the multi-chamber cylinder and connecting with the impact clutch unit. The multi-chamber cylinder has a body, a first chamber, and a second chamber communicating with the first chamber.

7 Claims, 7 Drawing Sheets

PNEUMATIC RATCHET WRENCH

FIELD OF THE INVENTION

The present invention relates to a pneumatic tool, and more particularly to a pneumatic ratchet wrench which is capable of outputting high torque.

BACKGROUND OF THE INVENTION

A conventional pneumatic ratchet wrench is operated in a single direction and contains a reducing gear set driven by an air motor of a single chamber cylinder so as to reduce an output rotating speed and to increase a torque, and then a crank shaft drives a ratchet yoke so as to actuate a drive square to rotate, wherein a pawl is shifted by a user to engage with the ratchet yoke, such that the drive square is controlled to rotate in a forward direction or a reverse direction. However, when the drive square of the conventional pneumatic ratchet wrench tighten a fastener (such as a screw or a bolt), the user has to resist a reaction force, thus causing the operation fatigue or damage.

With reference to FIGS. 1 and 2, another conventional pneumatic ratchet wrench is operation in a single direction and is driven by an air motor 11 of a single expansion chamber so as to actuate the impact clutch 12, such that a crank shaft 13 is driven by the impact clutch 12 to actuate a drive square 14 to rotate, wherein the air motor 11 has a cylinder 111, a single chamber 112 defined in the cylinder 111, two exhaust ports 113 formed on one side of the cylinder 111 and communicating with the single chamber 112, an inlet 114 arranged on one end of the cylinder 111 and connecting with the single chamber 112, and a rotor 115. Thereby, the rotor 115 drives the impact clutch 12 to actuate the crank shaft 13 so that the reaction force of the drive square 14 will not pass back to the user. But the air motor 11 rotates at a high speed, so the impact clutch 12 hits the crank shaft 13 in high frequency to shorten tool service life.

U.S. Pat. No. 7,080,578 discloses that a pneumatic ratchet wrench is driven by an air motor via a reduction gear set so as to actuate the impact clutch to operate in a low speed, and then the impact clutch drives a crank shaft to rotate a drive square. Yet such a pneumatic ratchet wrench includes the reduction gear set, thus having complicated structure and increasing the tool size, weight, and production cost.

The present invention has arisen to mitigate and/or obviate the afore-described disadvantages.

SUMMARY OF THE INVENTION

The primary object of the present invention is to provide a pneumatic ratchet wrench which is low reaction force, light weight simple construction and capable of outputting high torque.

To obtain the above objective, a pneumatic ratchet wrench is connected with an air supply device and contains: a housing, a ratchet head unit, an impact clutch unit, a driving unit, and a control valve.

The housing extends along a first axis line and includes an opening defined on one side of a front end thereof and an intake formed on a distal end thereof so as to couple with an air supply device.

The ratchet head unit is received in a front end of the housing and includes a drive square extending along a second axis line perpendicular to the first axis line and extending out of the opening.

The impact clutch unit is received in the housing and is coupled with the ratchet head unit.

The driving unit is disposed in a rear end of the housing and includes a multi-chamber cylinder, a rotor member inserted into the multi-chamber cylinder and connecting with the impact clutch unit so as to drive the drive square to rotate. The multi-chamber cylinder has a body, a first chamber defined in the body, a second chamber formed in the body and communicating with the first chamber.

DETAILED DESCRIPTION OF THE PREFERRED EMBODIMENTS

Figure 1:
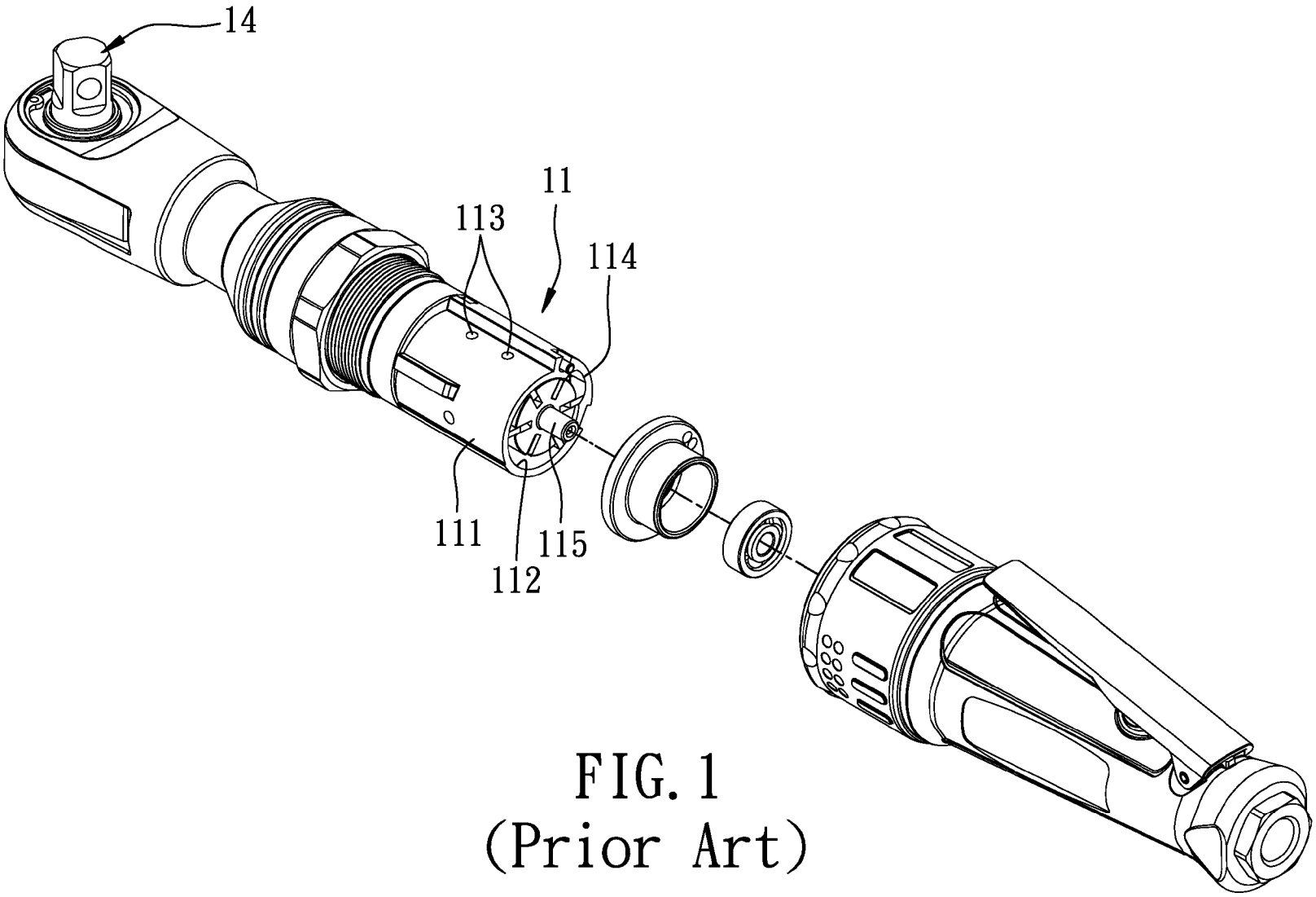
FIG. 1 (Prior Art)
FIG. 1 is a perspective view of a conventional pneumatic ratchet wrench.
Figure 2:
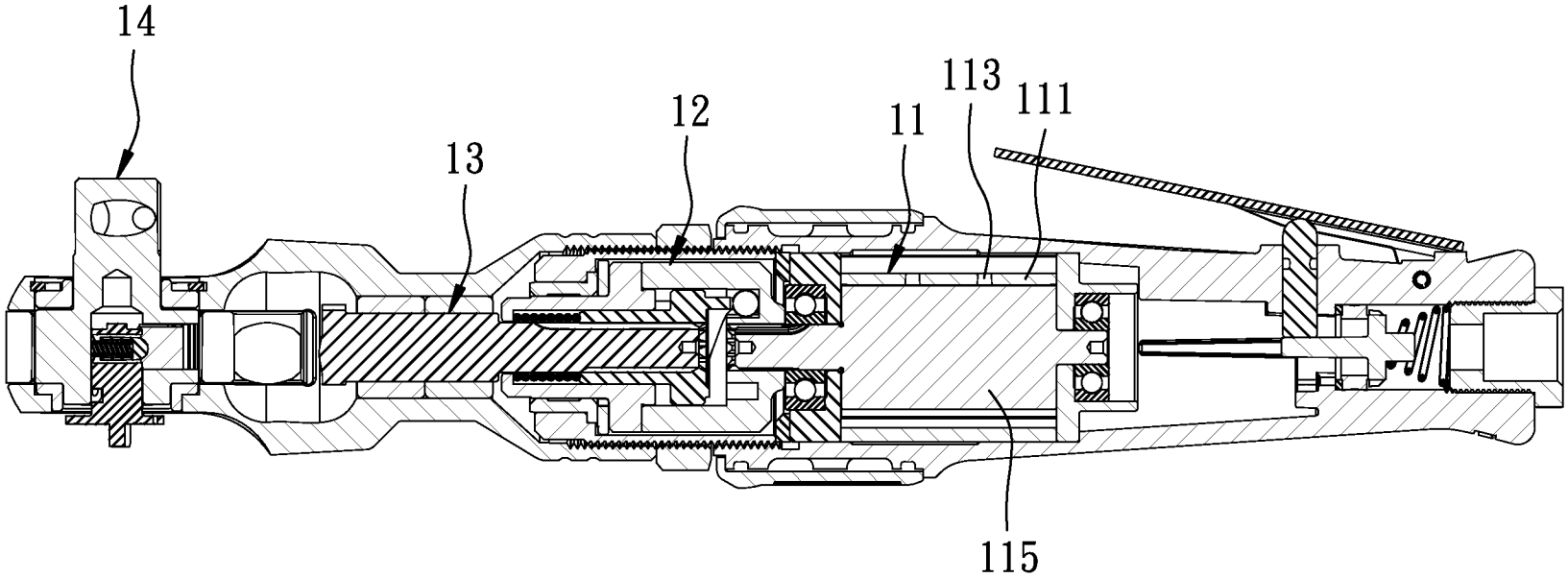
FIG. 2 (Prior Art)
FIG. 2 is a cross sectional view of the conventional pneumatic ratchet wrench.
Figure 3:
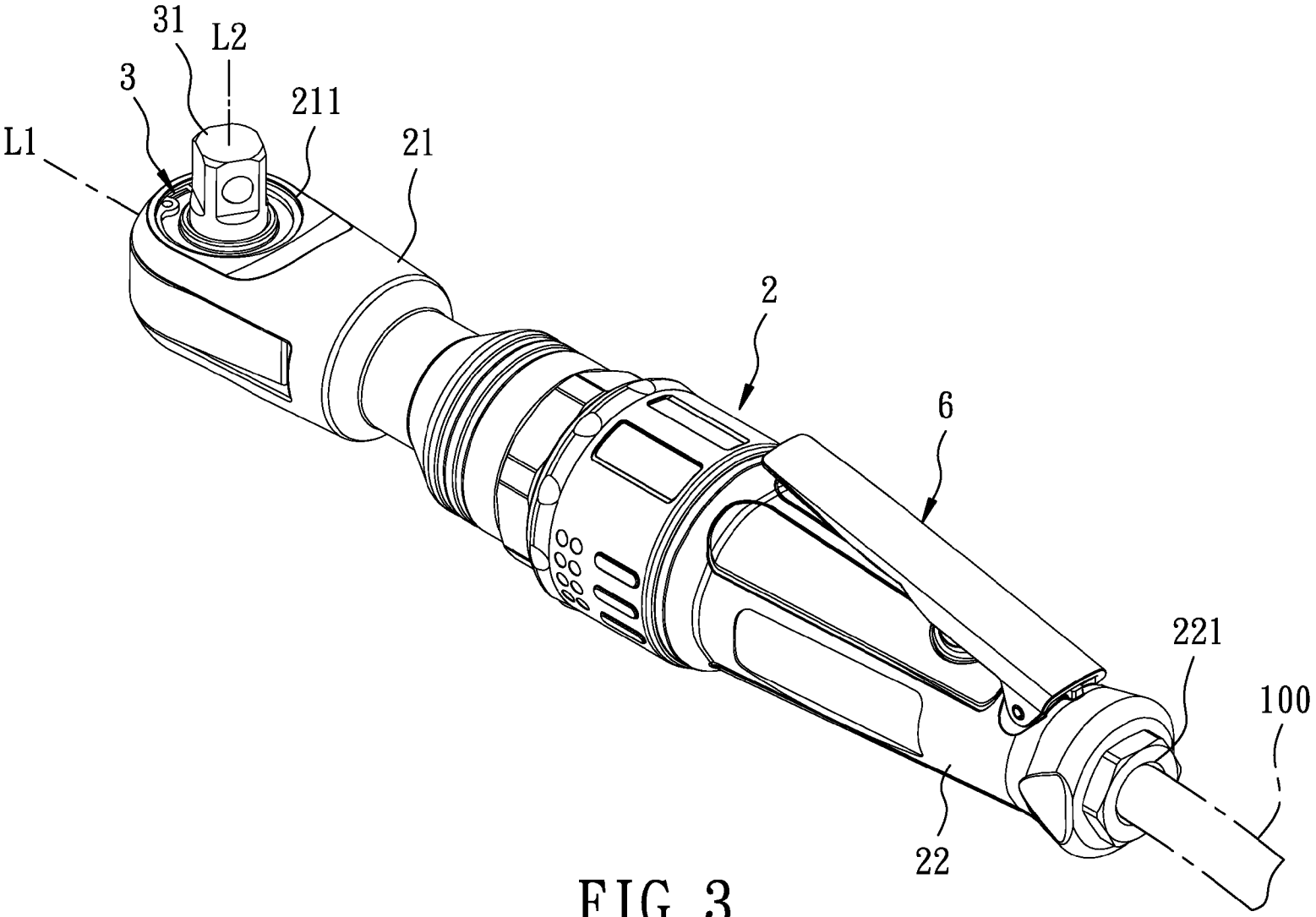
FIG. 3 is a perspective view showing the assembly of a pneumatic ratchet wrench according to a preferred embodiment of the present invention.
Figure 4:
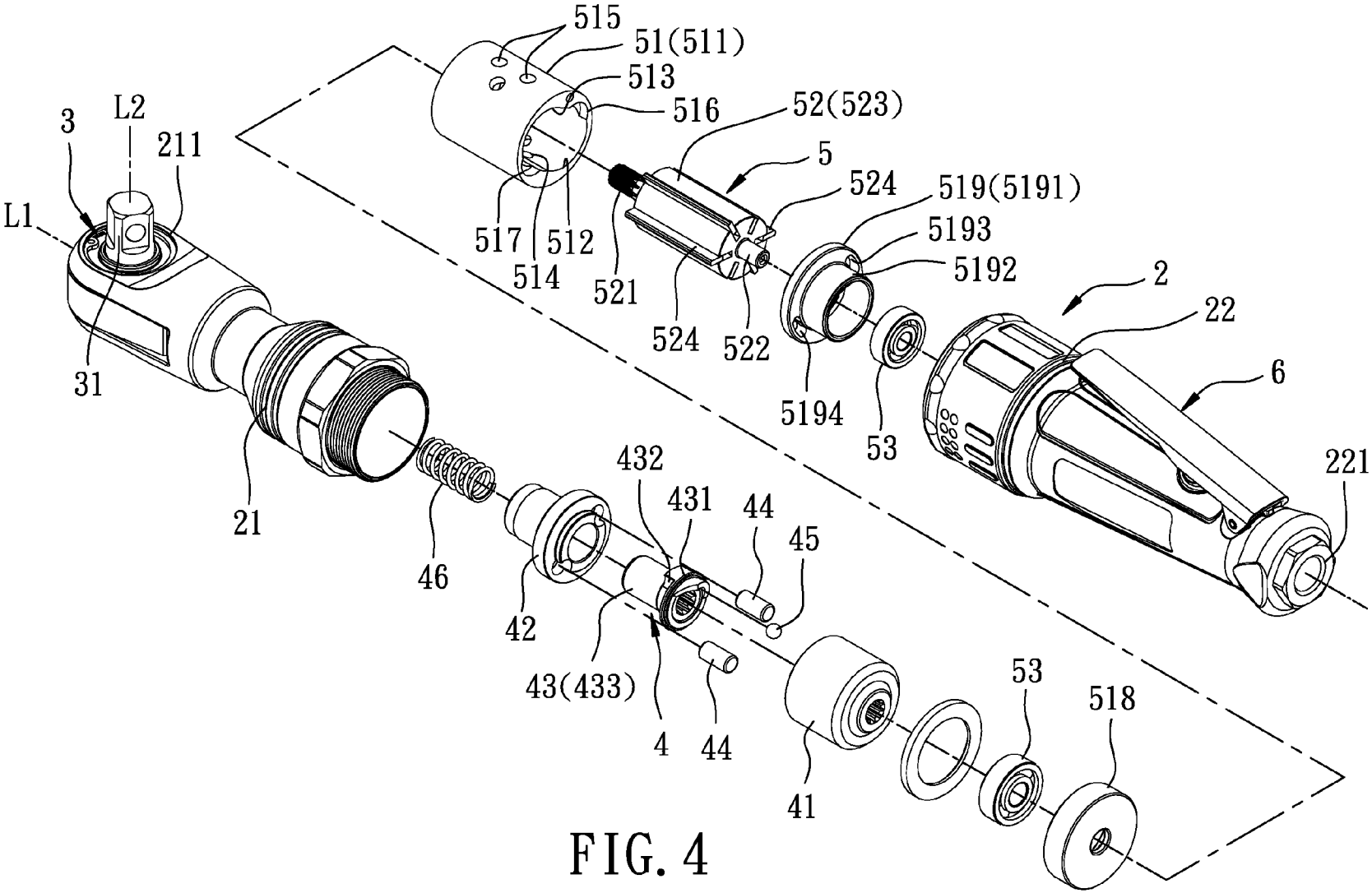
FIG. 4 is a perspective view showing the exploded components of a part of the pneumatic ratchet wrench according to the preferred embodiment of the present invention.

With reference to FIGS. 3 and 4, a pneumatic ratchet wrench according to a preferred embodiment of the present invention is connected with an air supply device 100 and comprises: a housing 2, a ratchet head unit 3, an impact clutch unit 4, a driving unit 5, and a control valve 6.

Figure 5:
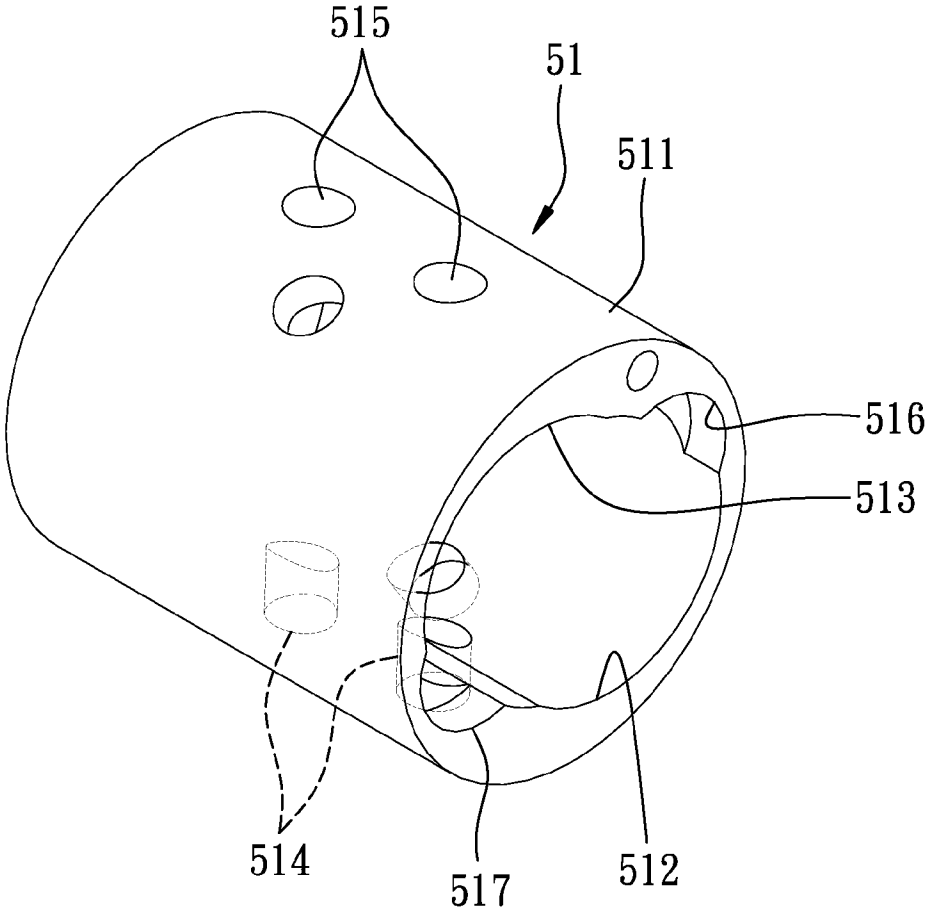
FIG. 5 is a perspective view showing the assembly of a multi-chamber cylinder of a driving unit of the pneumatic ratchet wrench according to the preferred embodiment of the present invention.
Figure 6:
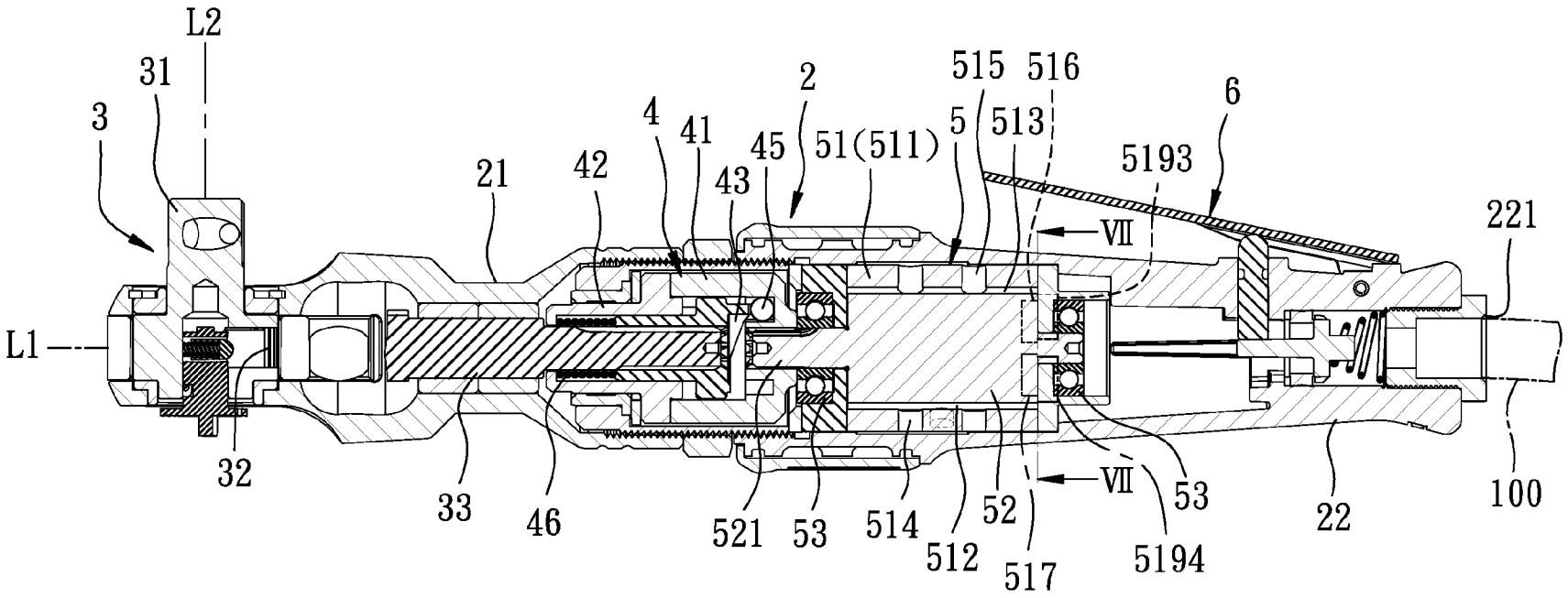
FIG. 6 is a cross sectional view showing the assembly of the pneumatic ratchet wrench according to the preferred embodiment of the present invention.

Referring further to FIGS. 4-6, the housing 2 extends along a first axis line L1 and includes a first casing 21 and a second casing 22 fixed in a rear end of the housing 2 and connected with the first casing 21, the first casing 21 has an opening 211 defined on one side of a front end thereof, the second casing 22 has an intake 221 formed on a distal end thereof so as to couple with the air supply device 100, such that air is fed into the intake 221 by the air supply device 100.

The ratchet head unit 3 is received in a front end of the housing 2 and includes a drive square 31 extending along a second axis line L2 perpendicular to the first axis line L1 and extending out of the opening 211, a ratchet mechanism 32 connected with the drive square 31, and a crank shaft 33 defined between the ratchet mechanism 32 and the impact clutch unit 4. Since the ratchet head unit 3 is a well-known art, further remarks are omitted.

The impact clutch unit 4 is received in the housing 2 and is coupled with the ratchet head unit 3, the impact clutch unit 4 includes a shell 41 mounted in the housing 2 and connected with the driving unit 4, a cap 42 joined with the shell 41, a cam rotating member 43 disposed in the shell 41, two striking posts 44 secured in the shell 41, a ball 45 fixed in the shell 41 so as to drive the cam rotating member 43 to rotate, and a spring 46 abutting against the cam rotating member 43 and the ratchet head unit 3 and fitted on the crank shaft 33. The cam rotating member 43 has a shoulder 431, two knocking blocks 432 formed on two sides of the flange 431 and matching with the two striking posts 44, and a sleeve 433 extending outwardly from the flange 431 and used to insert the crank shaft 33 of the ratchet head unit 3 so as to drive the drive square 31 to rotate. It is to be noted that although the impact clutch unit is in the scope of the present invention, because the impact clutch unit 4 is a well-known art, further remarks are omitted.

The driving unit 5 is disposed in the second casing 22 of the housing 2 and includes a multi-chamber cylinder 51, a rotor member 52 inserted into the multi-chamber cylinder 51 and connecting with the shell 41 of the impact clutch unit 4 so as to drive the drive square 31 to rotate, and two bearings 53.

The multi-chamber cylinder 51 has a body 511, a first chamber 512 defined in the body 511, a second chamber 513 formed in the body 511 and communicating with the first chamber 512, at least one first exhaust port 514 arranged on a first side of the body 511 and communicating with the first chamber 512, at least one second exhaust port 515 defined on a second side of the body 511 and communicating with the second chamber 513, a first inlet 516 formed on a first end of the body 511, connecting with the first chamber 512, and separated from the at least one first exhaust port 514, a second inlet 517 formed on the first end of the body 511, connecting with the second chamber 513, and separated from the at least one second exhaust port 515, a hollowly front end plate 518 mounted on a second end of the body 511, and a rear end plate 519 disposed on the first end of the body 511. In this embodiment, a number of the at least one first exhaust port 514 and the at least one second exhaust port 515 is three, so three first exhaust ports 514 are fixed on the first side of the body 511 in a triangle arrangement, and three second exhaust ports 515 are disposed on the second side of the body 511 in a triangle arrangement, such that air flows out of the first chamber 512 and the second chamber 513 via the three first exhaust ports 514 and the three second exhaust ports 515.

The rear end plate 519 has a circular flange 5191 for connecting with the body 511, a hollow fixing portion 5192 extending outwardly from the circular flange 5191 and served to receive one of the two bearings 53, a first orifice 5193 defined in the circular flange 5191 and communicating with the first inlet 516, and a second orifice 5194 defined in the circular flange 5191 and communicating with the second inlet 517.

The rotor member 52 has an output shaft 521 defined on a first end thereof and inserted into the hollowly front end plate 518, a rear shaft 522 mounted on a second end thereof and rotatably inserted into the rear end plate 519, a circular column 523 fixed between the output shaft 521 and the rear shaft 522 and received in the body 511, and a plurality of vanes 524 arranged around the circular column 523.

The two bearings 53 are mounted on the hollowly front end plate 518 and the rear end plate 519 and are provided to inert the output shaft 521 and the rear shaft 522.

Figure 7:
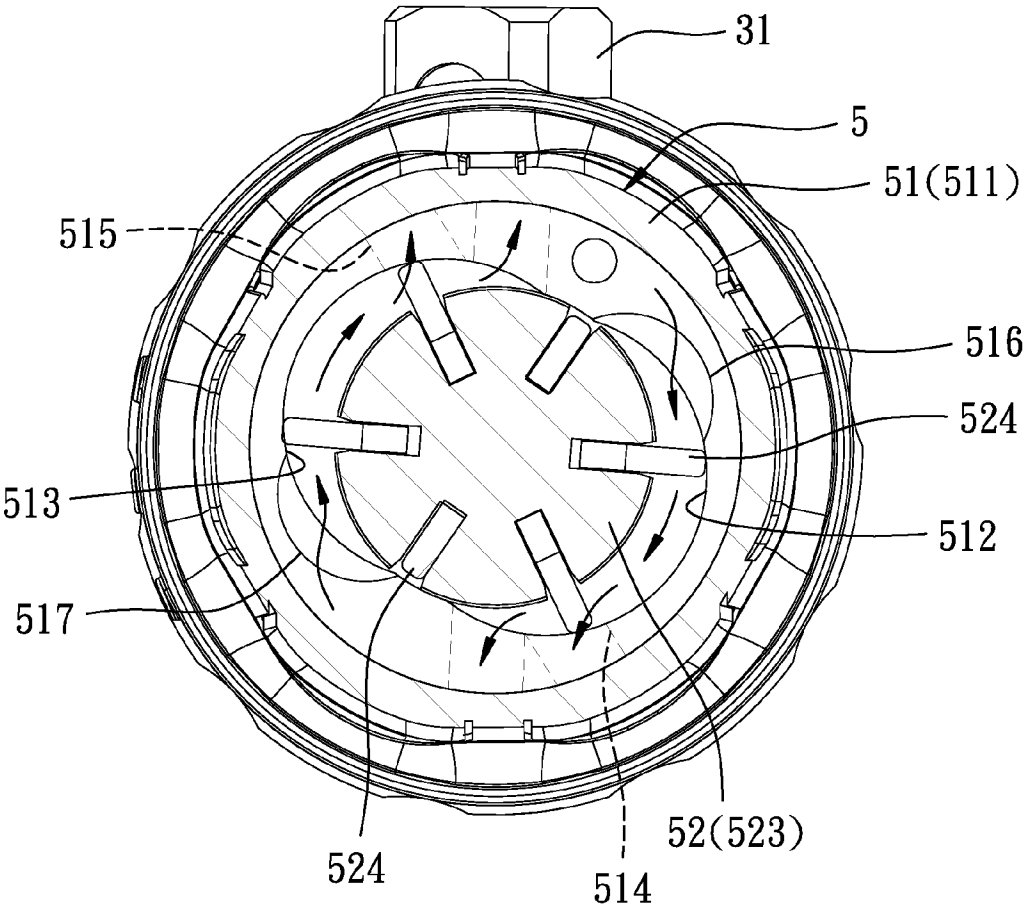
FIG. 7 is a cross sectional view taken along the line VII-VII of FIG. 6.

As shown in FIGS. 6 and 7, in operation, the control valve 6 is pressed so that the air supply device 100 supplies the air into the first inlet 516 and the second inlet 517 from the intake 221, such that the air pushes the plurality of vanes 524 to move toward the body 511 so that when the plurality of vanes 524 rotate, each vane 524 contacts with an inner wall of the body 511 tightly. After the air flows into the first chamber 512 and the second chamber 513 to drive the rotor member 52 to rotate, the air is compressed, inflates and flows out of the three first exhaust ports 514 and the three second exhaust ports 515. Because the multi-chamber cylinder 51 includes the first chamber 512 and the second chamber 513, even though the air flows at a low flow rate, a high output torque drives the rotor member 52 to actuate the impact clutch unit 4, hence the drive square 31 is driven by the impact clutch unit 4 to rotate. Preferably, the impact clutch unit 4 is driven by the rotor member 52 to operate at a low speed rotation, thus avoiding the impact clutch unit 4 and the ratchet head unit 3 damage.

Thereby, the pneumatic ratchet wrench of the present invention has the following advantages:

1. The multi-chamber cylinder 51 cooperates with the rotor member 52 so that after the air supply device supplies the air into the first chamber 512 and the second chamber 513 via the first inlet 516 and the second inlet 517, the rotor member 52 is driven by the air to rotate, and then the air flows out of the three first exhaust ports 514 and the three second exhaust ports 515. The rotor member 52 accordingly rotates at the low speed drive the impact clutch unit 4 to operate, thus preventing the impact clutch unit 4 and ratchet head unit 3 from damage.

2. The pneumatic ratchet wrench of the present invention are not provided with a reduction gear set (not shown) of above-mentioned prior arts, thereby simplifying structure and reducing size, weight, and production cost.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A pneumatic ratchet wrench being connected with an air supply device and comprising:

a housing extending along a first axis line and including an opening defined on one side of a front end thereof and an intake formed on a distal end thereof so as to couple with the air supply device;

a ratchet head unit received in a front end of the housing and including a drive square extending along a second axis line perpendicular to the first axis line and extending out of the opening;

an impact clutch unit received in the housing and coupled with the ratchet head unit;

a driving unit disposed in a rear end of the housing and including a multi-chamber cylinder, a rotor member inserted into the multi-chamber cylinder and connecting with the impact clutch unit so as to drive the drive square to rotate, the multi-chamber cylinder having a body, a first chamber defined in the body, a second chamber formed in the body and communicating with the first chamber;

wherein the multi-chamber cylinder also has at least one first exhaust port arranged on a first side of the body and communicating with the first chamber; at least one second exhaust port defined on a second side of the body and communicating with the second chamber; a first inlet formed on a first end of the body, connecting with the first chamber, and separated from the at least one first exhaust port; a second inlet formed on the first end of the body, connecting with the second chamber, and separated from the at least one second exhaust port, wherein the air supply device supplies air into the first chamber and the second chamber from the intake via the first inlet and the second inlet, such that the air drives the rotor member to rotate and then flows out of the first chamber and the second chamber via the at least one first exhaust port and the at least one second exhaust port;

wherein a number of the at least one first exhaust port and the at least one second exhaust port is three, and three first exhaust ports are fixed on the first side of the body in a triangle arrangement, three second exhaust ports are disposed on the second side of the body in a triangle arrangement.

2. The pneumatic ratchet wrench as claimed in claim 1, wherein the multi-chamber cylinder also has a hollowly front end plate mounted on a second end of the body and a rear end plate disposed on the first end of the body, the rotor member has an output shaft defined on a first end thereof and inserted into the hollowly front end plate and a rear shaft mounted on a second end thereof and rotatably inserted into the rear end plate.

3. The pneumatic ratchet wrench as claimed in claim 2, wherein the driving unit also includes two bearings mounted on the hollowly front end plate and the rear end plate and provided to insert the output shaft and the rear shaft.

4. The pneumatic ratchet wrench as claimed in claim 3, wherein the rear end plate has a circular flange for connecting with the body, a hollow fixing portion extending outwardly from the circular flange and served to receive one of the two bearings, a first orifice defined in the circular flange and communicating with the first inlet, and a second orifice defined in the circular flange and communicating with the second inlet.

5. The pneumatic ratchet wrench as claimed in claim 2, wherein the rotor member has a circular column fixed between the output shaft and the rear shaft and received in the body, the rotor member also has a plurality of vanes arranged around the circular column.

6. The pneumatic ratchet wrench as claimed in claim 2, wherein the impact clutch unit includes a shell mounted in the housing and connected with the driving unit, a cap joined with the shell, a cam rotating member disposed in the shell, two striking posts secured in the shell, a ball fixed in the shell so as to drive the cam rotating member to rotate, and a spring abutting against the cam rotating member and the ratchet head unit and fitted on the crank shaft; the cam rotating member has a shoulder, two knocking blocks formed on two sides of the shoulder and matching with the two striking posts, and a sleeve extending outwardly from the shoulder and used to insert the crank shaft of the ratchet head unit so as to drive the main spindle to rotate.

7. The pneumatic ratchet wrench as claimed in claim 6, wherein the ratchet head unit also includes a crank shaft inserted into the sleeve and used to fit the spring so as to drive the drive square to rotate.

* * * * *